United States Patent [19]

Waffner

[11] 4,253,597

[45] Mar. 3, 1981

[54] LOOSE LOOP FEED CONTROL APPARATUS

[75] Inventor: William D. Waffner, East Aurora, N.Y.

[73] Assignee: Moore Business Forms, Inc., Grand Island, N.Y.

[21] Appl. No.: 55,550

[22] Filed: Jul. 9, 1979

[51] Int. Cl.[3] ..... B65H 23/18

[52] U.S. Cl. ..... 226/40; 242/185

[58] Field of Search ..... 226/40, 25, 38, 30, 226/41; 137/182; 242/75.3, 183, 185; 101/180

[56] References Cited

U.S. PATENT DOCUMENTS

| | | | |
|---|---|---|---|
| 2,897,754 | 8/1959 | Spiller | 101/180 |
| 3,138,168 | 6/1964 | Waller | 137/182 |
| 3,485,427 | 12/1969 | Busker | 226/25 |
| 3,561,654 | 2/1971 | Greiner | 226/25 |
| 4,025,026 | 5/1977 | Merritt et al. | 242/185 |

*Primary Examiner*—Leonard D. Christian

*Attorney, Agent, or Firm*—Allegretti, Newitt, Witcoff & McAndrews

[57] ABSTRACT

Apparatus for controlling the infeed speed of a web of material relative to the outfeed speed so that damage to the web will be minimized. The control apparatus senses the length of a loose loop formed by the web and includes a moving belt provided with perforations along its length and which is, in part, positioned between a vacuum chamber and the downwardly depending portion of the web loop. The downwardly descending portion of the web loop is held in contact with the adjacent surface of the perforated belt by a low level vacuum in the vacuum chamber and the position of the loop, with respect to the number of the holes in the belt covered by the downwardly descending portion of the loop, regulates the degree of vacuum in the vacuum chamber. As the loop lengthens, the vacuum increases in a vacuum chamber behind the belt, conversely, when the loop shortens, the vacuum in the chamber decreases. A signal corresponding to the vacuum in the vacuum chamber is communicated to a pressure transducer-amplifier. An output signal from the transducer-amplifier is used to control the operation of a ratio changing device which includes a variable pitch sheave and which changes the infeed speed of the web in accordance with the output signal. The use of the control apparatus permits the direction of the web to be changed through an angle of 180° and also permits the web to be inverted, without undue risk of damage to the web.

9 Claims, 5 Drawing Figures

FIG. 3
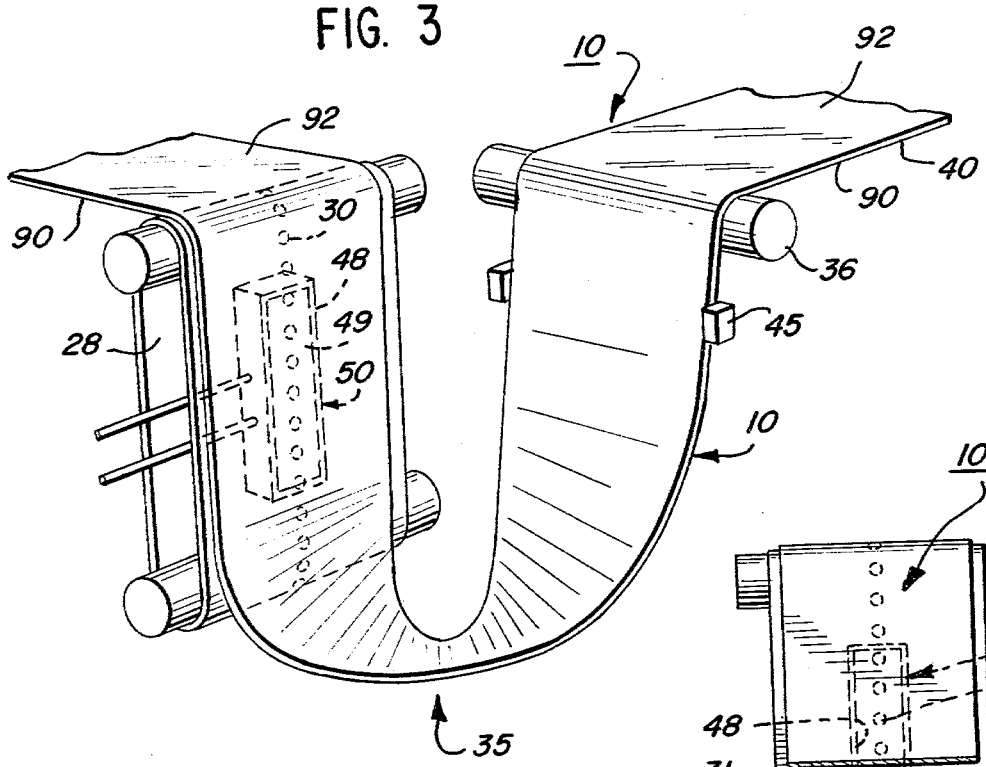
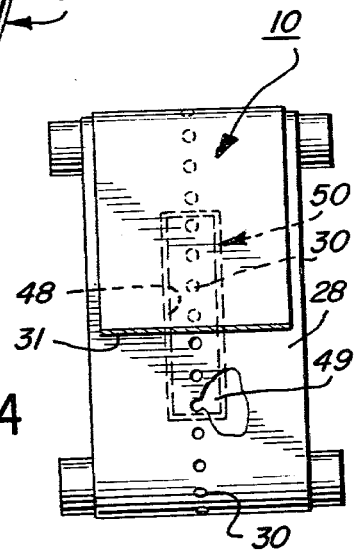
FIG. 4
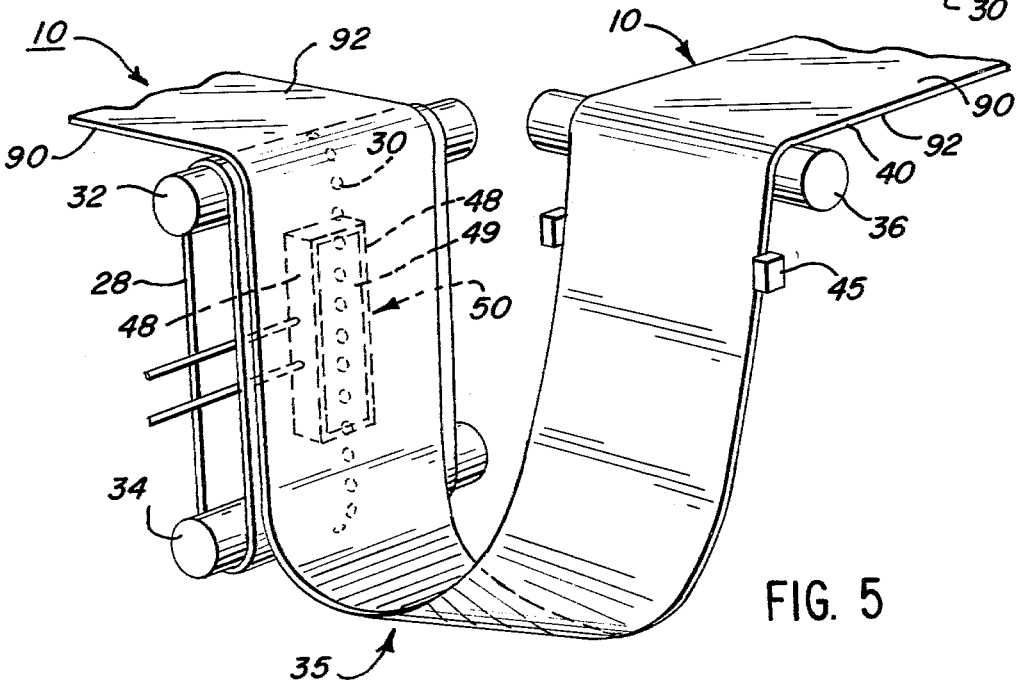
FIG. 5

LOOSE LOOP FEED CONTROL APPARATUS

BACKGROUND AND SUMMARY OF THE INVENTION

It has long been known that the feeding of web material, such as paper or other fragile sheeting, from an input to an output is best accomplished by permitting a loose loop to form in the web between the inlet and the outlet. With such a loop, the web will not be damaged if there are changes in the relative infeed and outfeed speeds of the web. However, if the infeed speed remains greater than the outfeed speed, the loop will continually grow in size. Conversely, if the infeed speed remains less than the outfeed speed, the loop will continually diminish in size, and this may result in the total disappearance of the loop.

Control over the infeed and outfeed speeds of the web in order to maintain a loose loop becomes particularly critical when the web is utilized in a system wherein the tension of the web must be kept uniform. For example in the printing industry, it is common for web-fed rotary printing presses to withdraw the web from a supply roll and draw the web through one or more printing units of the press. In a multiple inking process, the individual printing inks are applied to the web in succession and must therefore be accurately registered. To obtain accurate registration, the web must remain in constant tension while traveling along the length of the press. As is evident, non-uniform changes in the tension of the web during the printing process can directly effect the physical shape of the web, especially when using dampener-operated offset printing presses. Moreover, changes in the web tension can distort the intended printing operation by a printing unit if the change causes slippage between the impression cylinders. As a result, the correct registration of ink during the printing process can become very difficult or impossible.

Means to maintain a web with a desired loose web while operating under uniform tension has long been sought in the printing art, and many proposals have attempted to accomplish this. According to French Pat. No. 426,833, the tension of the web may be regulated by changes in the rotational speed of two rollers which withdraw the web from a supply roll. The changes in speed are controlled by the deflection of a pendulum roll which engages the web with a constant pressure. This simple and primitive method of web tension control can only eliminate disturbances caused by, and during the withdrawal of, the web from the supply roll.

Published German patent application No. 1,060,406 discloses a printing press in which pairs of power-driven conveyor rollers are positioned in front of and behind the printing unit or units of the press. The rotational speed of each pair of rollers is manually and independently adjustable. This German application also refers to means for measuring and controlling the web tension but does not further describe such means. In effect, the press arrangement described in the German application subdivides the web into several aligned but mutually separate portions which are adjusted independently of each other. As a result, there is no assurance that the tension of the web is stable and constant across the entire length of the web passing through the press. Moreover, if the web is to be printed on both sides, it is not possible to provide tension probing devices at various points along the length of the web passing through the press; such devices would smear the freshly printed ink.

U.S. Pat. No. 2,897,754 discloses a device in which the withdrawal speed of the web is controlled by a friction belt drive acting upon the circumference of the web supply roll. The speed of the belt drive is controlled by the interposition of a finely adjustable variable speed gearing, which is controlled by the displacement of a tension roller placed behind the supply roll, acting upon the web as it is withdrawn from the roll. The device also incorporates suitably connected, finely adjustable variable speed gearings which allow for variations in the rotational speeds of pairs of conveyor rollers positioned ahead of the printing units and behind the drying units. The patent is silent as to the factors to be taken into account in determining the rotation speeds of the conveyor rollers placed behind the printing units. There are also no provision for comparing the rotational speed of the conveyor rollers behind the printing units with the rotational speed of the conveyor rollers in front of the printing units, and hence adjustment on the basis of such comparison is not possible.

U.S. Pat. No. 3,561,654 discloses a device for maintaining constant tension in a web of paper being withdrawn from a supply roll and conveyed through one or more printing units of a printing press. The device consists of two pairs of power-driven rollers, one placed in front and the other in back of the printing unit or units, a means for visually measuring digitally indicated speed differentials between the two pairs of rollers, and a potentiometer controlled means for adjusting the speed of the rollers to the desired value. The system is expensive to install and does not react quickly enough for use in modern high-speed printing press operations.

U.S. Pat. No. 3,485,427 discloses a tension controlling device. A complicated electronic circuit is relied upon to control the tension of a web.

U.S. Pat. No. 3,138,168 discloses a reverse acting, pneumatic amplifier which is generally structurally similar to the transducer-amplifier utilized in the loose loop feed control apparatus of the present invention. However, the apparent novel feature of this patented amplifier resides in the use of a single diaphram and an integral flapper combination as the only active element of the amplifier. This patent does not disclose nor teach the use of the patented amplifier in a loose loop feed control apparatus.

In the past, it was also known to use devices to control web tension between pairs of rollers by means of electrical pulses generated as a function of the rotational speeds of the rollers. The pulses are counted by a suitable counter and digitally totaled per unit of time. The totals obtained are used to measure rotation ratios and slippage. The relative rotational speeds of the roller pairs are then adjusted either by automatic or manual controls.

It is an object of the present invention to provide an improved apparatus which is utilized to control the infeed speed of a continuous web so that a loose loop is formed and maintained in the web so as to substantially eliminate damage to the web.

Another object of the present invention to provide an improved loose loop feed control apparatus wherein a vacuum signal, which varies as the length of the descending portion of the web loop increases or decreases, operates, through a transducer-amplifier, a ratio changing device, such as a variable pitch sheave, to automatically change the web's infeed speed to match the web's outfeed speed, without the necessity of manually adjusting the speeds or providing complicated electronic means to do so.

A still further object of the present invention is to provide an improved loose loop feed control apparatus of the type described wherein because of the usage of the apparatus, the direction of the web may be changed through a substantial angle, for example, 90° or even 180° degrees, and wherein the web can be turned upside down, i.e., the top and bottom sides or surfaces of the web can be reversed, without substantial risk of damage to the web.

DESCRIPTION OF THE DRAWINGS

FIG. 3 is a perspective view of the loop of web material, with its associated vacuum chamber and perforated belt, illustrating a 90° turn in the web adjacent to the outfeed side of the loop;

FIG. 4 is a partial, front elevational view of the perforated belt and vacuum chamber showing the descending portion of the web blocking some of the perforations in the belt; and FIG. 5 is a view similar to FIG. 3 wherein the web is not only turned 90°, adjacent to its outfeed side, but is also reversed with respect to the side of the web which is uppermost.

DESCRIPTION OF THE PREFERRED EMBODIMENT

Figure 1:
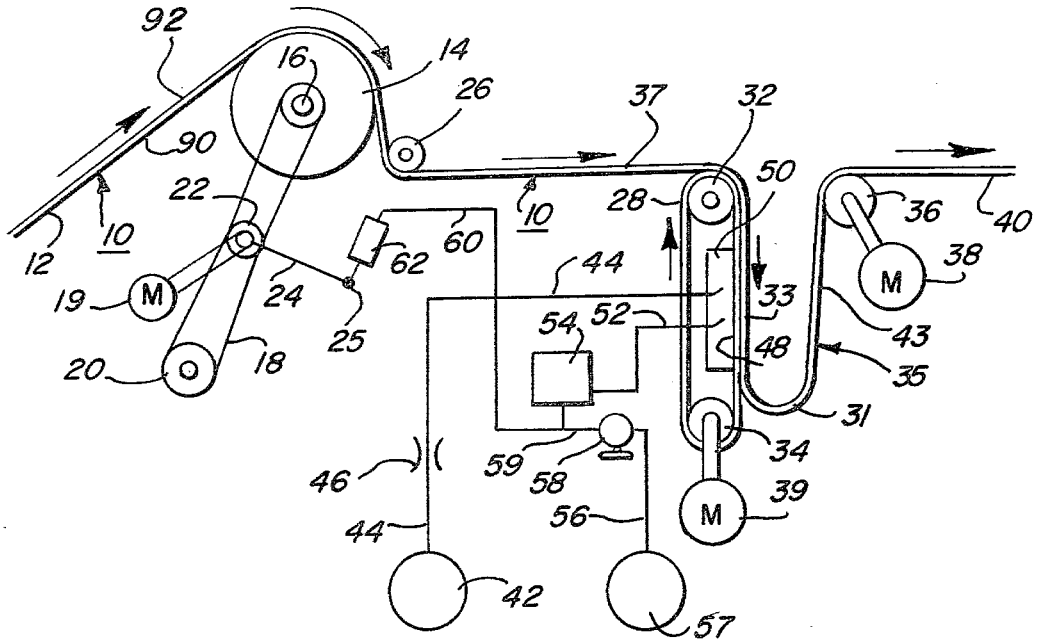
FIG. 1 is a schematic view of the improved apparatus of the present invention.

As noted above, the preferred embodiment of the loose loop feed control apparatus of the present invention is shown schematically in FIG. 1 and is utilized to control the feeding of a web 10 to a desired destination, not shown, such as, for example, a printing press, wherein it is exceedingly important to maintain a uniform rate of web feed to the printing press rollers in order to obtain correct registration of inks. The web 10 is made of paper although it could, of course, be made of other materials.

Initially, as indicated by the portion 12, the web 10 is drawn from a conventional supply roll, not shown. The web infeed speed is regulated by a variable speed feed roll 14. A pulley 16 is mounted on the roll 14 and is driven by an endless belt 18 which is, in turn, driven by a pulley 20 connected to a constant speed motor 19. The speed of the rotation of the pulley 16, and thus the feed roll 14, is varied by a conventional variable pitch sheave 22, known in the art as a "Varisheave", which is operated and controlled, in a conventional manner, by a pair of rods 24. An air pressure controlled means, hereinafter described, pivots the rods 24 about a pivot 25, and the position of the rods 24 controls the sheave 22. The portion 37 of the web 10, downstream from the feed roll 14, passes under an idler roll 26 and over an endless belt 28 which is driven around pulleys 32 and 34. The belt 28 includes a plurality of evenly spaced, uniform diameter apertures 30 disposed along its longitudinal center-line, as best shown in FIGS. 3–5. A constant speed motor 39 connected with the pulley 34, is used to drive the belt 28 at a constant speed.

The infeed and outfeed speeds of the web 10 are initially set so that a loop, generally indicated at 35, is formed in the web 10. The loop 35 is defined by a descending portion 33, by an ascending portion 43 and by a downwardly formed portion 31 interconnecting the bottom of the portions 33 and 43. The portion 40 of the web 10, downstream from the loop 35, is carried by and passes over an outfeed roll 36, driven by a constant speed motor 38, to a destination which as noted above, may be a printing press such as a four color printing press.

A source of vacuum, diagrammatically shown at 42 in FIG. 1, is preferably of the conventional blower type and is connected, through a vacuum line 44, to a vacuum chamber 50 disposed adjacent to a portion 95 of the belt 28 and between the pulleys 32 and 34. A vacuum restriction valve 46 is disposed in the line 44. The vacuum chamber 50 is provided with longitudinal edges 48 which define a longitudinal extending opening 49 therein facing the portion 95 of the belt 28. The chamber 50 is constructed so that the portion 95 of the belt 28 is maintained in tight contact with the edges 48 by the vacuum in chamber 50.

A vacuum line 52 connects the vacuum chamber 50 with a transducer-amplifier 54. The amount of vacuum existing in line 52 will be determined by the vacuum present in the vacuum chamber 50, which vacuum is varied in a manner hereinafter described.

A conventional air compressor, shown diagrammatically at 57, supplies compressed air to a transducer-amplifier 54 through a conduit 56, a calibrated air pressure valve 58, and another conduit 59. More specifically one end of the conduit 59 is connected to the valve 58 and its other end is connected to the lower end of a tube 68 by means of a fitting 66 in the base 64 of the transducer-amplifier 54. The tube 68 is disposed within the transducer-amplifier 54 and has a relatively small control bleed orifice 70, e.g., on the order of 0.025 inches, in its other, upper end. An expandable bellows 72 is secured to the base 64 of the transducer-amplifier about the tube 68 and is moved longitudinally by changes in vacuum/pressure acting on its walls. The exterior portion of the walls of the bellows 72 is subjected to the atmospheric pressure of the fluid 76 contained in the exterior casing 74 of the transducer-amplifier 54. The casing 74 also contains an orifice plate 75 having an opening 77 which damps the motion of the fluid 74. Since the casing 74 has an opening 78 in its upper end, atmospheric pressure will act on the fluid 76, and thus the exterior of the bellows 72.

The vacuum line 52 is connected to a bore 80 in the base 64 of the transducer-amplifier 54. The bore 80 communicates with a passage 82 in the base 64. The passage 82, in turn, communicates with the interior of the bellows 72.

Figure 2:
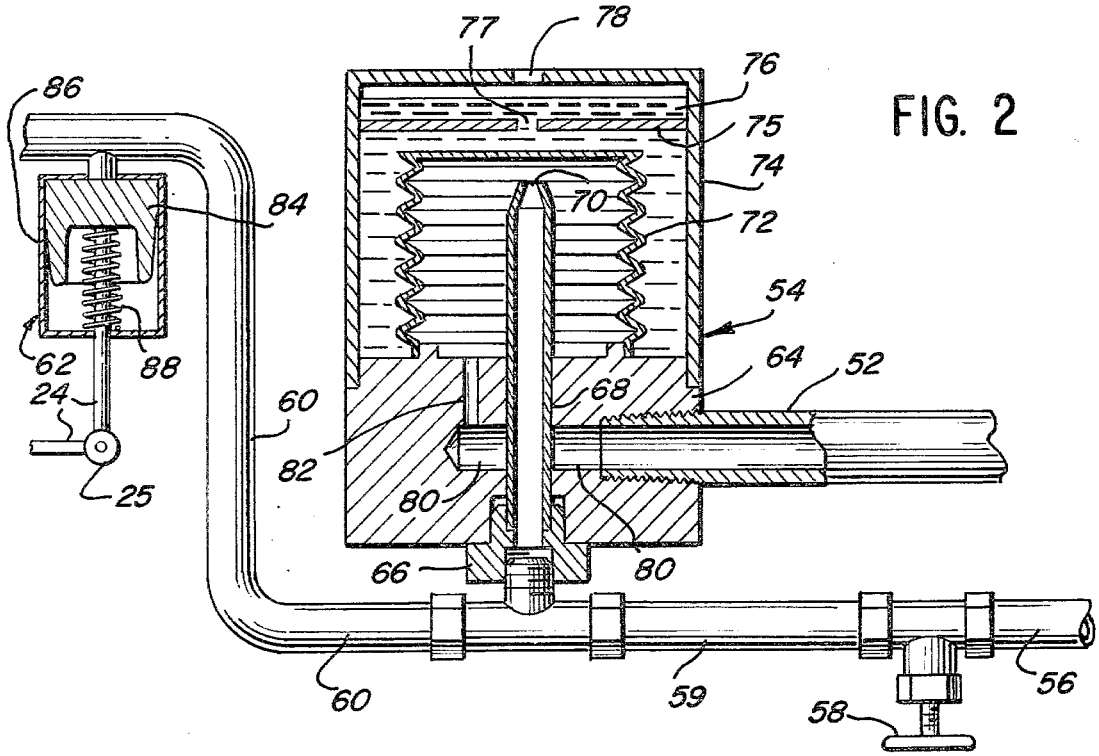
FIG. 2 is an enlarged sectional view of the transducer-amplifier used as a component in the loose loop feed control apparatus of the present invention.

As best shown in FIGS. 1 and 2, a conduit 60 interconnects the other end of the conduit 59 and a "Bellofram" type cylinder 62 so that compressed air in the conduits 59 and 60 can communicate with the cylinder 62. More specifically, the cylinder 62 includes a cylinder casing 86 and a piston slidably mounted therein so that one face of the piston 86 is in communication with the compressed air in conduit 60. Depending upon the pressure of the compressed air in the conduit 60, the piston 84 may be moved in the cylinder casing 86 against the force of a coil compression spring 88 which extends between the other face of the piston 84 and the adjacent end of the casing 86. The piston 84 is connected to the operating rods 24, through the pivot 25, so that movement of the piston 84 moves the rods 24. As noted above, movement of the rods 24 causes them to change the pitch of the "Verisheave" sheave 22, and hence, the speed of rotation of the pulley 16, which drives the roll 14, may be varied in response to the position of the piston 84.

OPERATION

The loose loop feed control apparatus is generally arranged and the web is started on its course as described above and as shown in FIG. 1. Because the belt 28 passes over the opening 49 in the vacuum chamber 50 and is maintained in a tight, sealing relationship with the edges 48 of the vacuum chamber 50, the degree of vacuum in the chamber 50 will depend upon the number of apertures 30 in the belt 28 which are covered by the downwardly descending portion 33 of the loop 35 of the web 10. If the outfeed speed of the web 10 decreases, relative to its infeed speed, the loop 35 is lengthened so that more of the apertures 30 in the belt 28 are covered by the web. When all of the apertures 30 are covered by the portion 33 of the loop 35 of the web 10, such as, for example, shown in FIG. 3, the vacuum in the chamber 50 will be relatively high because there is very little leakage of atmospheric air into the chamber 50. However, if the outspeed of the outgoing portion 40 of the web 10 becomes greater than the inspeed of the portions 12 of the web, the loop 35 will shorten. Consequently and as shown in FIG. 4, some of the apertures 30 in the belt 28 will become uncovered to the atmosphere. This permits more air, at atmospheric pressure, to enter the chamber 50, and thus decreases the vacuum in the chamber 50. When all of the apertures 30 are uncovered by the web loop 35, the vacuum in the chamber 50 will be relatively low because there is the maximum leakage of atmospheric air into the chamber 50.

While the outfeed and infeed speeds of the web 10 are relatively constant and remain in a selected, desired relationship, the vacuum in the chamber 50 will remain generally unchanged because the length of the portion 33 of the loop 35 will remain the same. However when there is a change in the outfeed speed of the web 10, relative to its infeed speed, there will be a proportional change in the vacuum in the chamber 50. Such a change in the vacuum is transmitted, as a vacuum signal, through the vacuum line 52 to the transducer-amplifier 54. This vacuum signal causes the position of the bellows 72 to change with respect to the orifice 70 in the tube 64. The change in the position of the bellows 72, with respect to the orifices 70, causes a change in the air pressure in the conduits 59 and 60 which, in turn, causes the piston 84 to move within the cylinder 86 under or against the bias of the spring 88. Movement of the piston 84 causes the rods 24 to change the position of the sheave 22. This, in turn, changes the speed of the pulley 16 and hence the speed of the roller 14. A change in the speed of the roller 14 causes a corresponding change in the infeed speed of the web 10 so that the infeed and outfeed speeds of the web will return to their desired relationship and so that a loop 35 of a predetermined length will again exist.

For example, when the degree of the vacuum in the chamber 50 increases (because the web outfeed speed has decreased with respect to the web infeed speed so as to lengthen the portion 33 of the loop 35 and cover more apertures 30 in the belt 28), the change in the vacuum signal from the chamber 50 will cause the bellows 72 to more restrict the orifice 70. Such increased restriction will cause the air pressure in the conduits 59 and 60 to increase since a similar volume of compressed air will be bled through the orifice 70. When the air pressure in the conduits 59 and 60 increases, the piston 84 of the cylinder 62 will be forced outwardly against the bias of the spring 88. Such movement of the piston 84 causes the connecting rods 24 to move around the pivot 25 so as to change the position of the Verisheave sheave 22. This repositioning of the sheave 22 causes the speed of the pulley 16 and roller 14, and thus the infeed speed of the web 10, to be decreased so that the downwardly descending portion 33 of the loop 35 again shortens and exposes more of the apertures 30 in the belt 28.

When the degree of the vacuum in the chamber 50 decreases, due to an increase in the web outfeed speed relative to the web infeed speed, the opposite occurs: namely, the bellows 72 expands and permits increased compressed air to bled from the conduits 59 and 60. Thus the piston 84 will be moved under the bias of the spring 88, and this movement of the piston 84 changes the position of the rods 24, and thus the sheave 22, is changed so as to increase infeed speed of the web 10.

The transducer-amplifier 54 serves, in effect, to convert a low pressure vacuum signal into high pressure compressed air signal which, in turn, is used to control the length of the downward portion 33 of the loop 35. The employment of the transducer-amplifier 54 permits the apparatus to operate with a relatively low level vacuum supplied by a conventional blower 42 rather than by relatively high vacuum supplied by a conventional vacuum compressor. This affords a practical advantage in that vacuum compressors frequently present maintenance problems. The transducer-amplifier 54 is capable, if properly adjusted, of amplifying a vacuum signal varying from 135 inches to 0.8 inches of $H_2O$ to an air pressure signal varying from 10 and 25 psig—a pressure gain of over 900.

As shown in FIG. 3, the web 10 may be turned through an angle of 90° and conveyed outwardly through the guides 45 and over the drive roller 36, with the bottom surface 90 of the web 10 being in contact with the roller 36. Similarly the web 10 may be turned up through an angle of substantially 180°. As shown in FIG. 5, the web 10 may also be reversed so that the top surface, indicated at 92 as the web passes over the feed roller 14, becomes the bottom surface, as the web passes over the roller 36, and so that bottom surface, indicated at 90 as the web passes over the feed roller 14, becomes the top surface as the web passes over the roller 36.

From the foregoing, it is apparent that I have provided an improved apparatus for controlling the infeed speed of a loose loop of a web to match its outfeed speed so that damage to the web is minimized. Furthermore, the components used to control the web feed speed are relatively simple in construction and inexpensive to manufacture. The usage of the apparatus also permits the direction of the web to be changed through a substantial angle and the top and bottom surfaces of the web to be reversed, while still maintaining the proper relative infeed and outfeed speeds.

Thus, since the invention disclosed herein may be embodied in other specific forms without departing from the spirit or central characteristics thereof, the preferred embodiment described herein is therefore to be considered in all respects as illustrative and not restrictive, the scope of the invention being indicated by the appended claims, rather than by the foregoing description, and all changes which come within the meaning and range of equivalency of the claims are therefore intended to be embraced therein.

I claim:

1. An improved apparatus for feeding a web of material from a source of supply to a desired destination, wherein the web forms a vertical loose loop between the source of supply and the desired destination, wherein the web is infed from the source of supply to the loose loop along a first predetermined direction, wherein the web moves from the loose loop toward the desired destination along a second predetermined direction, and wherein the loose loop of the web has a descending side, an ascending side and a downwardly extending curved portion interconnecting the lower ends of the descending and ascending sides of the loose loop;

means for feeding the web to the loose loop along the first predetermined direction and at a variable infeed speed, the feeding means including means for varying the infeed speed of the web;

a belt positioned to be in surface to surface contact with the web along at least a portion of the descending side of the loose loop, the belt having a series of evenly spaced perforations therein adapted to be positioned beneath the web when the web is in contact with the belt;

a source of vacuum;

a chamber having an open side disposed, in surface to surface engagement, with the belt on the side of the belt opposite its web-contacting surface;

means for connecting the source of vacuum with the chamber so that the degree of vacuum in the chamber may be varied by the number of perforations in the belt covered by the descending side of the loose loop of the web; and means responsive to the variation in the degree of vacuum in the chamber for controlling the infeed speed varying means, and in turn, for controlling the infeed speed of the web to the loose loop.

2. The improved apparatus as described in claim 1 wherein the means for varying the infeed speed of the web includes a variable pitch sheave.

3. The improved apparatus as described in claim 2 wherein the vacuum responsive means includes a transducer amplifier that controls the position of the sheave which in turn, controls the infeed speed of the web.

4. The improved apparatus as described in claim 1 wherein the vacuum responsive means includes a transducer amplifier which is responsive to the degree of vacuum in which the degree of vacuum is controlled by the number of perforations in the belt covered by the descending side of the loose loop in the web.

5. The improved apparatus as described in claim 1 wherein the means for varying the infeed speed of the web includes a cylinder operated by compressed fluid; and wherein the pressure of the compressed fluid is controlled by and is responsive to the degree of vacuum in the chamber.

6. The improved apparatus as described in claim 2 wherein the vacuum responsive means includes a transducer amplifier responsive to the degree of vacuum in the chamber; and wherein a compressed air cylinder, which is controlled by the vacuum transducer, in turn controls the variable pitch sheave that drives the web at varying infeed speeds so as to match the web infeed speed with the outfeed speed of the web.

7. The improved apparatus as described in claim 1 wherein there is an angle formed between the first predetermined direction of the web and the second predetermined direction of the web.

8. The improved apparatus as described in claim 7 wherein the angle between the first predetermined direction and the second predetermined direction is at least 90°.

9. The improved apparatus as described in claim 8 wherein the angle is substantially 180°.

* * * * *